United States Patent [19]

Knowles

[11] 4,292,934

[45] Oct. 6, 1981

[54] STARTING AIDS FOR INTERNAL COMBUSTION ENGINES

[75] Inventor: Richard P. Knowles, Farnborough, England

[73] Assignee: Lucas Industries Limited, Birmingham, England

[21] Appl. No.: 733,366

[22] Filed: Oct. 18, 1976

[30] Foreign Application Priority Data

Oct. 24, 1975 [GB] United Kingdom ..... 43736/75

[51] Int. Cl.[3] ..... F02P 19/02; F02B 9/08

[52] U.S. Cl. ..... 123/145 A; 361/266

[58] Field of Search ..... 123/145 A, 30 A, 122 F, 123/184; 361/264, 266

[56] References Cited

U.S. PATENT DOCUMENTS

| | | | |
|---|---|---|---|
| 1,525,624 | 6/1923 | Suter | 123/145 A |
| 1,590,892 | 6/1926 | Heany | 123/145 A |
| 2,130,365 | 9/1938 | Paulson | 123/145 A |
| 3,297,914 | 1/1967 | Staintsbury | 361/264 |
| 3,434,012 | 3/1969 | Rademacher | 123/145 A |
| 3,749,980 | 7/1973 | Baxter | 123/145A |

FOREIGN PATENT DOCUMENTS

| | | | |
|---|---|---|---|
| 1016747 | 1/1966 | United Kingdom | 361/264 |

*Primary Examiner*—P. S. Lall

[57] ABSTRACT

A starting aid for a diesel engine comprises a tubular member which in use extends into a combustion space of the engine, a spirally coiled heating element which is located in the end of the tube and which at its inner end is connected to a conductive rod. The outer end of the element is connected to a length of conductive tape extending substantially normal to the plane of the heating element. The tape at its other end is electrically connected to the tubular member. Conveniently the length of tape is formed as an extension of the tape forming the heating element this tape being folded so that the length of tape extends as described.

11 Claims, 3 Drawing Figures

STARTING AIDS FOR INTERNAL COMBUSTION ENGINES

This invention relates to a starting aid for a diesel engine and of the kind which in use is mounted within the cylinder head of an engine so that the heated portion of the aid is exposed within a combustion space of the engine, the aid comprising a spirally coiled heating element formed from conductive tape which is located within and at the end of a tubular member, the outer end of the heating element being electrically connected to the tubular member, the inner end of the heating element being electrically connected to a conductive rod extending within the tubular member.

An example of such a starting aid is described in the Specification of British Pat. No. 1,127,454. It is essential that a starting aid of the kind described should have a long service life. During use the heating element and the end portions of the tubular member and rod are exposed to the temperature and atmosphere existing within the combustion space and are also subjected to engine vibration. In addition when the aid is turned on during starting of the engine the temperature of the heating element rises rapidly.

It has been found that the heating element of the aid described in the aforesaid Patent Specification can under certain conditions of use, fracture with the result that the aid is no longer able to carry out its intended purpose.

The object of the invention is to provide a starting aid of the kind specified in an improved form.

According to the invention in a starting aid of the kind specified a length of tape connected to the outer end of the heating element extends in a direction transversely to the plane of the heating element, said length of tape being secured at or adjacent its free end to the tubular member or body of the aid at a position removed from the heating element.

According to a further feature of the invention said length of tape is continuous with the tape forming the heating element, the tape being folded so that said length of tape extends transversely to the plane of the heating element.

According to a further feature of the invention said tape is folded so that said length of tape extends from the outer side of said outer end of the heating element.

One example of the starting aid in accordance with the invention will now be described with reference to the accompanying drawings in which.

With reference to the drawings the starting aid comprises a body part having defined within it a bore 11. At one end the body part is of enlarged section and is of non-circular form to enable a spanner or the like to be engaged therewith. Moreover, formed on the periphery of the body part adjacent the enlarged portion is a screw thread whereby the aid may be mounted within a complimentary bore formed in the wall of the cylinder head of the engine. At its end remote from the enlarged portion of the body part defines a conical portion 12 which in conjunction with a complimentary portion formed in the bore in the cylinder head of the engine, defines a gas tight seal.

The bore 11 at its end remote from the enlarged portion of the body, is of enlarged diameter to accomodate a tubular member 13, the tubular member being brazed or otherwise secured within the body part. Conveniently the member 13 is formed from a heat resistant alloy.

Figure 1:
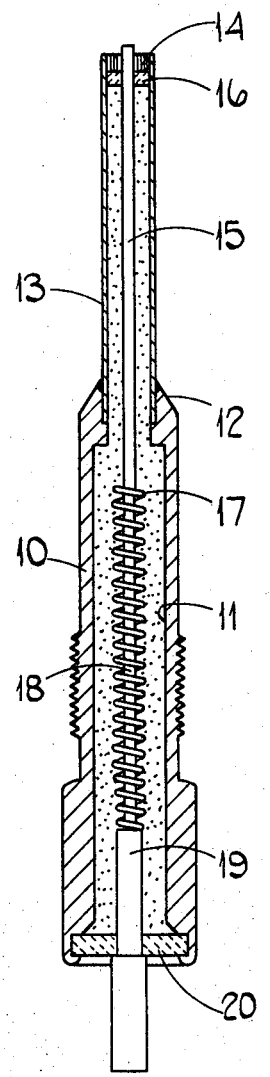
FIG. 1 is a sectional side elevation of the aid.
Figure 2:
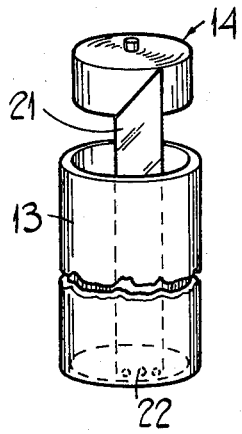
FIG. 2 is a view to an enlarged scale of a portion of the aid during the course of manufacture.

Located within and adjacent the free end of the member 13 is a heating element 14 which is seen more clearly in FIG. 2. The element 14 comprises a spirally wound resistive tape and the inner end of the tape is secured to a rod 15 extending through the tubular member 13 to within the bore 11. Located adjacent the heating element 14 is a ceramic bead 16 which serves to support the heating element and the space defined between the rod 15 and the inner surface of the tubular member 13 is filled with an electrically insulating material conveniently glass which is fused so as to establish a gas tight seal.

The end of the rod 15 within the bore 11 is connected to one end of a resistance element 17 which conveniently surrounds an insulating support 18. The other end of the resistance element is connected to a further metal rod 19 which extends from the bore 11 and has mounted thereon a terminal. The rod 19 extends through a further ceramic bead 20 and this may be retained in position by rolling over the end portion of the body as shown, or it may be retained by a terminal secured to the rod 19. The resistance element 17 together with the rod 18 and the rod 19 are held in position within the bore 11 by a fused glass filling.

The outer end of the resistance element 14 is electrically connected to the tubular member 13 and the conductive tape forming the resistance element is provided on one or both sides with an insulating coating.

The temperature coefficients of resistance of the heating element and the resistance element are chosen in conjunction with the actual values of resistance, so that when the aid is connected to a source of supply, the heating element 14 will be quickly heated owing to the fact that the resistance element 17 being cold will have a low resistance and therefore a high current will flow through the heating element. As the resistance element starts to heat its resistance will increase thereby reducing the magnitude of the current flowing through the heating element. The reduction of current means that the power dissipated in the heating element is reduced so that the heating element can be designed to heat up very quickly but the danger of overheating which would result in self destruction, is minimised.

As previously mentioned the heating element comprises a spirally wound tape which prior to the winding operation, is secured to the rod 15. The element is then wound and when of the appropriate size, a length 21 of the tape at the outer end of the element, is folded so that the length extends generally normal to the plane of the heating element. Conveniently and as shown in FIG. 2, the length is folded so that it lies to the outer side of the outer end of the heating element. The length of tape 21 is then secured as by welding indicated at 22, to the end of the tubular member 13 remote from the main portion of the heating element. The welding is of course carried out before the tubular member is inserted in the body and it will be understood that the welding is only carried out after the wound tape has been inserted into the end of the tubular member 13.

It is preferred that the length of tape be folded as indicated in FIG. 2 because if this is done then experience has shown that it is not necessary to provide a flat on the periphery of the bead 16 providing the dimensions of the bead are carefully chosen. If however the length 21 is folded in the opposite direction so that it lies on the inner side of the outer end of the heating element then it is thought necessary to provide a flat on the bead so as to avoid undue stress in the region of the outer end of the element when the bead is placed in position. The main purpose of the bead 16 is to prevent the glass flowing into the heating element when the glass is fused. Although not shown in the drawings, it is possible to deform the free end portion of the tubular member by a small amount so as to adjust the clearance between the tubular member and the heating element. If this is done then the heating element is more securely located within the end of the tubular member.

In an alternative arrangement the end of the length 21 of tape is secured to the tubular element or the body during the brazing process which is necessary to secure the tubular member to the body. In the former case the outer end of the heating element is directly connected to the tubular member whereas in the latter case it is indirectly connected to the tubular member by way of the body.

As with the starting aid described in the aforementioned Patent Specification the body and tubular member can be provided with a coating of a release agent to enable the starting aid to be readily removed from the bore in the engine when so required. In some instances it is desirable to utilise an adaptor which itself is threaded into the bore in the engine, the starting aid then being threaded into the adaptor. The adaptor can provide if it should prove necessary, for additional cooling of the starting aid whilst it is in use, thereby extending the service life of the aid.

Figure 3:
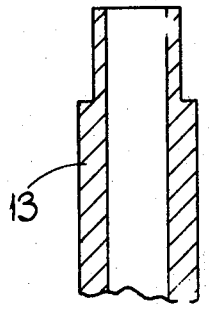
FIG. 3 is a section to an enlarged scale of a modified portion of the aid.

In order to increase the rate at which the heating element attains it operating temperature the thermal inertia of the aid is reduced in the area of the heating element. For this purpose and as shown in FIG. 3 the free end portion of the tubular member 13 has a reduced overall diameter. This also has the effect of allowing the heating element and the end of the tubular member to attain a higher temperature when the heating element is not energised thereby promoting the self cleaning action.

I claim:

1. A starting aid for a diesel engine the aid being of the kind which in use is mounted within the cylinder head of an engine so that the heated portion of the aid is exposed within a combustion space of the engine, the aid comprising a spirally coiled heating element formed from conductive tape which is located within and at the end of a tubular member, the outer end of the heating element being electrically connected to the tubular member, the inner end of the heating element being electrically connected to a conductive rod extending within the tubular member, and a length of tape connected to the outer end of the heating element extends in a direction transversely to the plane of the heating element, said length of tape being secured at or adjacent its free end to the tubular member or body of the aid at a position removed from the heating element.

2. A starting aid according to claim 1, including a glass filling between the inner wall of the tubular member and said rod, said filling acting to locate the rod within the member.

3. A starting aid according to claim 2, including a ceramic bead positioned between the element and the glass filling.

4. A starting aid according to claim 1, in which said length of tape is continuous with the tape forming the heating element, the tape being folded so that the length of tape extends transversely to the plane of the heating element.

5. A starting aid according to claim 4, in which the length of tape extends from the outer side of said outer end of the heating element.

6. A starting aid according to claim 5, in which the length of tape is spot welded to the tubular member.

7. A starting aid according to claim 5, in which the length of tape is secured to the tubular member or body during brazing of the tubular member to the body.

8. A starting aid according to claim 6, in which said tubular member is of reduced section at its free end.

9. A starting aid according to claim 6, in which the free end of the tubular member is turned inwardly to assist the retention of the heating element within the tubular member.

10. A starting aid according to claim 7, in which said tubular member is of reduced section at its free end.

11. A starting aid according to claim 7, in which the free end of the tubular member is turned inwardly to assist the retention of the heating element within the tubular member.

* * * * *